US007775354B2

(12) United States Patent
Latchford et al.

(10) Patent No.: US 7,775,354 B2
(45) Date of Patent: Aug. 17, 2010

(54) WATERPROOF COVER FOR PERSONAL MUSIC PLAYER

(76) Inventors: Janet Lee Latchford, 439 Boyd Cir., Michigan City, IN (US) 46360; Lynette Kay Werner, 310 E. Coolspring Ave., Michigan City, IN (US) 46360; Bryan Jon Lempia, 543 Lathrop Ave., River Forest, IL (US) 60305

( * ) Notice: Subject to any disclaimer, the term of this patent is extended or adjusted under 35 U.S.C. 154(b) by 616 days.

(21) Appl. No.: 11/734,752

(22) Filed: Apr. 12, 2007

(65) Prior Publication Data

US 2007/0241012 A1 Oct. 18, 2007

Related U.S. Application Data

(60) Provisional application No. 60/791,525, filed on Apr. 12, 2006.

(51) Int. Cl.
*B65D 85/30* (2006.01)

(52) U.S. Cl. ..... 206/320; 206/701; 150/165

(58) Field of Classification Search ..... 206/320, 206/576, 701, 720, 722, 316.1; 150/154, 150/165

See application file for complete search history.

(56) References Cited

U.S. PATENT DOCUMENTS

| | | | | |
|---|---|---|---|---|
| 4,584,718 | A * | 4/1986 | Fuller | 455/351 |
| 5,706,940 | A * | 1/1998 | Amarello | 206/320 |
| 5,873,456 | A * | 2/1999 | Hull et al. | 206/38.1 |
| 6,273,252 | B1 * | 8/2001 | Mitchell | 206/320 |
| 6,396,769 | B1 | 5/2002 | Polany | |
| 6,659,274 | B2 * | 12/2003 | Enners | 206/305 |
| 6,915,934 | B2 | 7/2005 | Hassett | |
| 6,954,405 | B2 | 10/2005 | Polany et al. | |
| 6,961,434 | B2 | 11/2005 | Silverman | |
| 7,158,376 | B2 | 1/2007 | Richardson et al. | |
| 7,180,735 | B2 | 2/2007 | Thomas et al. | |
| 7,490,721 | B2 * | 2/2009 | Bishop | 206/316.2 |
| 2002/0122353 | A1 | 9/2002 | Polany et al. | |
| 2002/0196948 | A1 | 12/2002 | Silverman | |
| 2005/0030707 | A1 | 2/2005 | Richardson et al. | |
| 2005/0123161 | A1 | 6/2005 | Polany et al. | |

(Continued)

OTHER PUBLICATIONS

H2O Audio Waterproof Headphones, item #31035 from retail website Frontgate.com; date unknown.

(Continued)

*Primary Examiner*—Jacob K Ackun, Jr.
(74) *Attorney, Agent, or Firm*—Lempia Braidwood LLC

(57) ABSTRACT

A waterproof enclosure for use with personal music players has a case formed of a flexible material and creates an interior sized to receive a personal music player. The case in one example can have a first part and a second part that together define the interior The case can be opened to expose the interior and can be closed along a joint. A watertight seal can be provided along the joint between the first and second parts when closed. In one example, a tether can connect the first and second parts of the case. In one example, the tether can be configured to create an attachment loop with the case in the closed position. The enclosure can also have a sound emitting device extending from the case. In one example, the sound emitting device can include a jack adapter integrally formed with the case.

10 Claims, 3 Drawing Sheets

U.S. PATENT DOCUMENTS

| | | | | |
|---|---|---|---|---|
| 2005/0161352 | A1* | 7/2005 | Huddleston | 206/320 |
| 2005/0174727 | A1 | 8/2005 | Thomas et al. | |
| 2005/0242143 | A1 | 11/2005 | Hassett | |
| 2006/0003709 | A1 | 1/2006 | Wood | |
| 2006/0077777 | A1 | 4/2006 | Fried | |
| 2006/0113203 | A1* | 6/2006 | Daley | 206/320 |
| 2006/0274493 | A1 | 12/2006 | Richardson et al. | |
| 2006/0279924 | A1 | 12/2006 | Richardson et al. | |
| 2007/0014491 | A1 | 1/2007 | MacAuley et al. | |
| 2007/0036376 | A1 | 2/2007 | Fried | |
| 2007/0070813 | A1 | 3/2007 | Kuo | |
| 2007/0261978 | A1* | 11/2007 | Sanderson | 206/320 |

OTHER PUBLICATIONS

H2O Waterproof Case for iPod, item #31036, #31038 & #30220 from retail website Frontgate.com; date unknown Waterproof iPod Stereo Case, item #30236 from retail website Frontgate.com; date unknown.

* cited by examiner

WATERPROOF COVER FOR PERSONAL MUSIC PLAYER

RELATED APPLICATION DATA

This patent is related to and claims priority benefit of U.S. Provisional Application Ser. No. 60/791,525, which was filed on Apr. 12, 2006, which was entitled "Waterproof Protective Covering with Earpiece Assembly for Personal Music Player," and which is incorporated herein by reference in its entirety.

BACKGROUND OF THE INVENTION

1. Field of the Disclosure

The present disclosure is generally directed to protective enclosures for personal music players, and more particularly to a waterproof cover that permits the use of a personal music player in a wet environment.

2. Description of Related Art

Small personal music players such as MP3 players and Apple's iPod products are known in the art. However, these products are not typically known to operate in a wet or aquatic environment. Protective and decorative skins and cases for these types of personal music players are also known in the art. However, a vast majority of these products are also not intended for use in a wet or aquatic environment. If a conventional personal music player is submerged in water or used in an environment with substantial moisture, these known skins or cases do not offer waterproof protection to prevent water damage to the personal music players.

There are several recent waterproof cases fro personal music players and other electronic items. The products are typically rigid shells that house the player. These products can be relatively heavy and bulky and do not allow a user to operate at least some controls while the music player is housed inside the case. These products also require attachment of a separate set of waterproof headphones. The attachment point between the headphones and the case can create a water leak potential.

There is at least one known waterproof case that is known to have a rigid case and a flexible membrane on a portion of the case to permit operation of some of the controls for the music player. The joint or seal between the shell and the membrane also can create a water leak potential.

Waterproof MP3 players and other personal music players are also commercially available. These types of units require a user to download their music to the waterproof player. Unless the user uses the waterproof player all the time, the user must have at least one other standard unit and maintain and update both products. This can include downloading music to both units.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

The present invention is directed to waterproof enclosures for personal music players and the like. The disclosed waterproof enclosures solve or improve upon one or more of the above-noted problems and disadvantages with personal music players and covers. In one example, a disclosed waterproof enclosure has a cover that is formed entirely of a flexible material such as silicone, rubber, or other elastomeric materials. In another example, a disclosed waterproof enclosure has an integral earphone device extending from a part of the case. In another example, a tether connects two parts of the waterproof case and creates an attachment loop for securing the waterproof enclosure to an article of clothing or other object to carry the device. In a further example, a disclosed waterproof enclosure includes an integral jack adapter that connects to an earphone jack on a personal music player when the enclosure is secured over the player. The disclosed waterproof enclosures permit an audio device such as a personal music player to be housed within the enclosure and to be used in a substantially wet environment, even while submerged to a limited depth during swimming, snorkeling, or the like.

Figure 2:
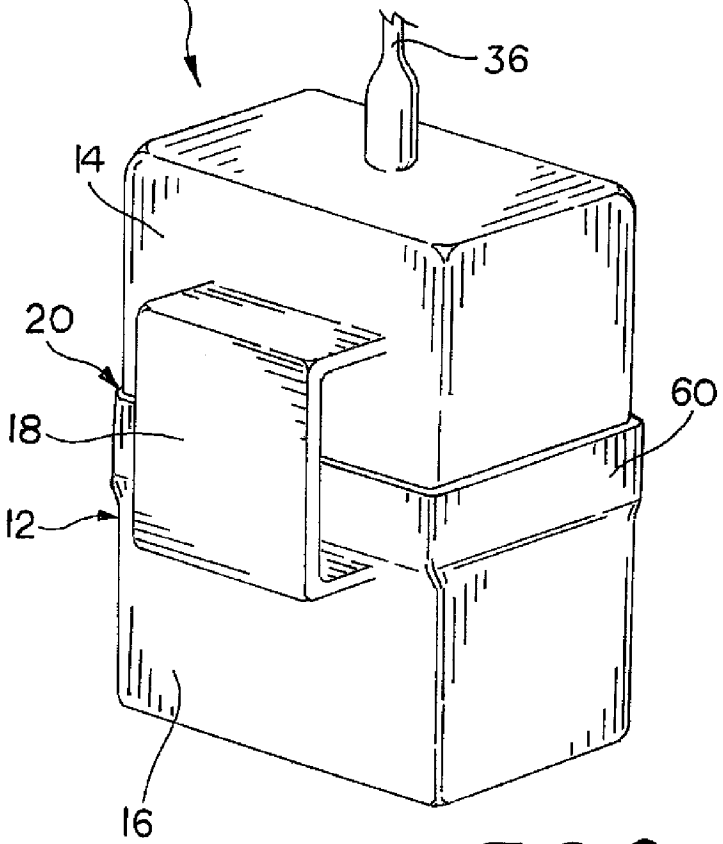
FIG. 2 shows a rear perspective view of the waterproof enclosure shown in FIG. 1.
Figure 1:
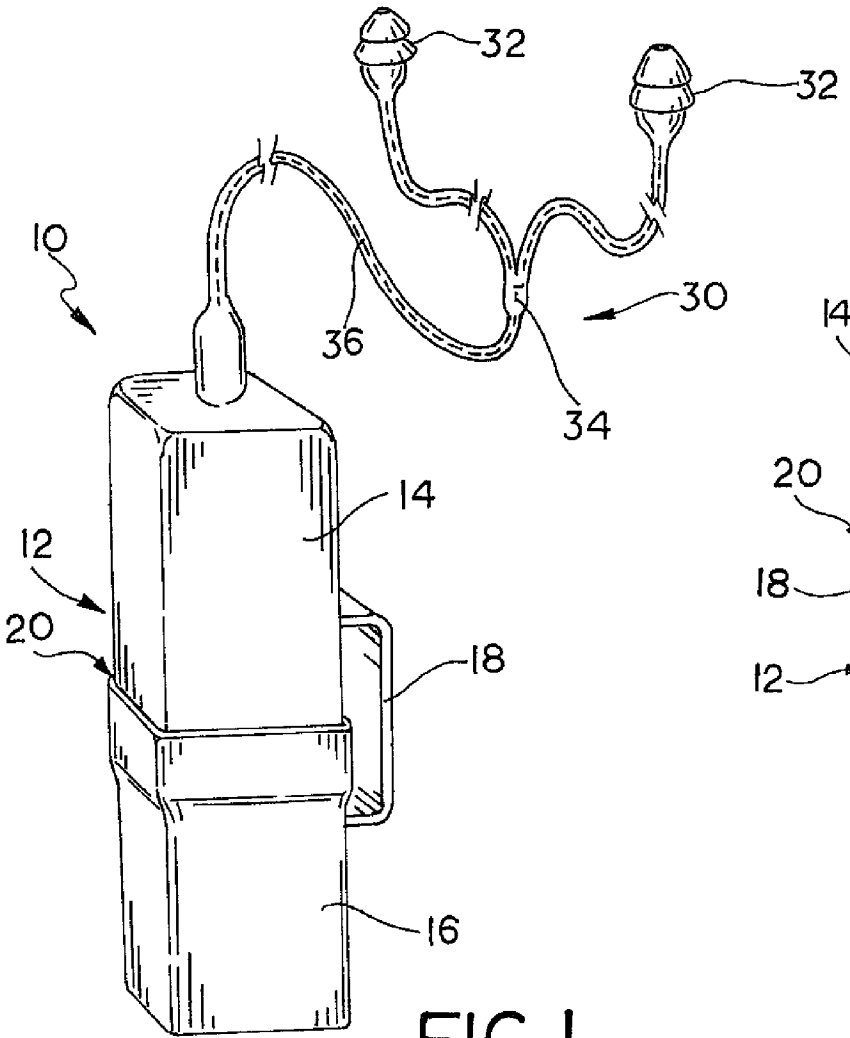
FIG. 1 shows a side perspective view of one example of a waterproof enclosure for a personal music player and which is constructed in accordance with the teachings of the present invention.

Turning now to the drawings, FIGS. 1 and 2 illustrate one example of a waterproof enclosure 10 constructed in accordance with the teachings of the present invention. The enclosure 10 is illustrated in a closed configuration. In the disclosed example, the enclosure 10 generally has a cover or case 12 formed in two parts including a first part 14 and a second part 16 that can be hingedly or otherwise coupled together. In one example, the two parts 14 and 16 are integrally attached to one another by a tether 18 formed integral with each of the cover parts. In an alternate example, the two case parts 14 and 16 can be integrally connected or otherwise attached to one another along one common edge of the openings into each section or part. As described below, each of the case parts is coupled to the other at a joint 20 in the closed configuration. The joint 20 forms a watertight seal between the two parts. A watertight interior space can thus be created inside the case 12 to house a personal music player or other electronic or audio device.

Also as shown in FIG. 1, the disclosed waterproof enclosure 10 includes an integral headphone, canal phone, earphone, or other such earpiece device 30. In the disclosed example, the earphone device 30 has a pair of ear buds 32 that can be placed in a user's ears. Each ear bud 32 can have an internal sound emitting component such as a small speaker as is known in the art. Waterproof earphones, headphones, and other types of earpieces are also known in the art. In the disclosed example, the ear buds 32 can encompass using virtually any kind of sound emitting component that can be used in an underwater environment and yet fall within the spirit and scope of the present invention.

In this example, the ear buds 32 are coupled to one another at a splitter 34, which in turn is coupled to the first part 14 of the case 12 by an elongate lineout or extension 36. The lineout 36 extends from a top of the first case part 14 in the disclosed example. As will be evident to those having ordinary skill in the art, the lineout 36 can extend from any part of the enclosure 10 and yet fall within the spirit and scope of the present invention. The positioning of the lineout 36, as will become apparent below, can be varied according to the particular personal music player for which the enclosure 10 is intended. The earpiece or earphone lineout 36 is coupled to the case 12 at a location where an earphone connector or adapter 40 is carried on the case. In this example, the adapter 40 includes a stem 42 projecting into the interior of the enclosure 10. The stem 42 in the disclosed example is a conventional contact prong that can be received in an opening or earphone jack in a personal music player as is known in the art.

The stem 42 in this example extends from a shoulder or annular flange 44 positioned against an interior surface 46 of the first part 14 in the enclosure. The adapter 40 in this example includes a tail 48 on the exterior side of the case 12. The tail 48 can be connected to one or more wire leads 50 as is known in the art. In the disclosed example, the earphone adapter 40 can be integrally molded or insert molded as a part of the case 12 using an insert mold process. The adapter 40, wires 50, and sound emitting components in the ear buds 32 can be held in place in a mold. The flexible material of the case 12 can be molded around these components. The shoulder or flange 44 is sized larger than the tail 48 and stem 42. The flexible material of the case 12 surrounds the tail 48 and bears against the shoulder 44 to retaining the adapter in place as a part of the case 12. The tail and/or the shoulder can be configured with surface features that interlock with the surrounding flexible material when molded to retain the adapter 40 in place as well. The shoulder in such an example could be eliminated entirely.

Figure 5:
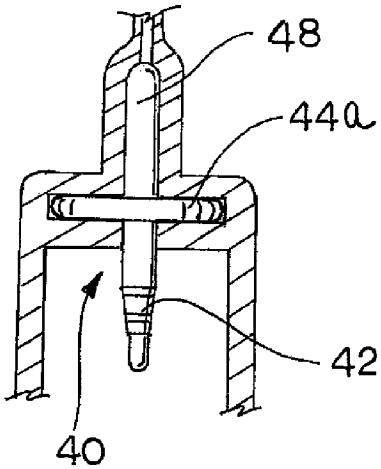
FIG. 5 shows an alternative example of an adapter arrangement for headphones on the waterproof enclosures disclosed herein.

FIG. 5 shows one alternative example where an annular flange or shoulder 44A is entirely encased within the flexible material of the case 12 molded around it. This particular embodiment would retain the adapter 40 from moving in any direction relative to the material of the case 12. In both examples, the adapter 40 positions the stem 42 in the interior of the case such that it is ready to be inserted into an adapter jack on a personal music player when the cover 12 is installed over the player. The flexible nature of the case material can be such that the stem 42 may easily be inserted into the player's jack during installation. The size and shape of the two case parts 14 and 16, as well as the position of the Joint 20 relative to the two parts, can be varied to accommodate different jack positions on particular personal music players.

Figure 6:
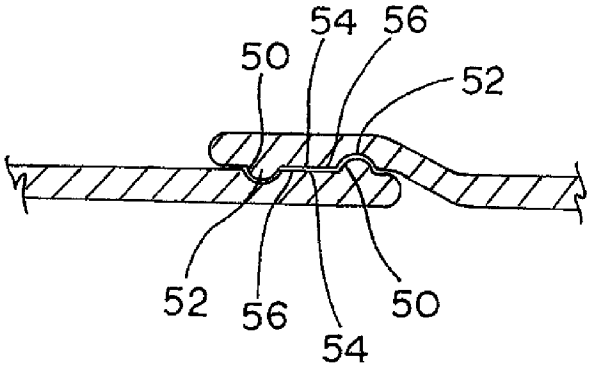
FIG. 6 shows an enlarged cross-section of one example of a watertight seal for the waterproof enclosure shown in FIG. 1.

As shown in FIG. 6, the joint 20 creates a seal between the first and second parts 14 and 16 of the cover 12. There are many different ways in which to form a seal at the joint 20. In one example (not shown) an interlocking press and seal closure strap can be provided around the circumference of the joint 20 wherein the two parts 14 and 16 contact one another. The two pars can be assembled and then the joint pressed to create the seal. In another example (not shown) a wiper seal arrangement can be created at the joint 20 to create a watertight seal when the two parts are assembled.

As shown in FIG. 6, a multi-point compression seal can be created at the joint 20. In one example, each of the parts 14 and 16 of the cover 12 can include one circumferential depression or groove 50 and one circumferential ridge or rib 52, each extending circumferentially around the part. The rib and groove on each part 14 and 16 can be spaced from one another as shown. When assembled, the rib 52 on each part will seat in the groove 50 in the other part to creating a dual interlock at the joint. The surface 54 between the rib 52 and the groove 50 on each part 14 and 16 can further be formed having one or more compression seal beads 56 also extending circumferentially around the respective parts. In this example, the surface 54 on each part includes one additional bead 56 extending circumferentially around the part. When assembled, the bead 56 on each part presses against a flat region on the surface 54 of the other part between the seated grooves 50 and ribs 52. Thus, a dual compression seal is formed at the joint between the pairs of seated ribs and grooves.

Figure 4:
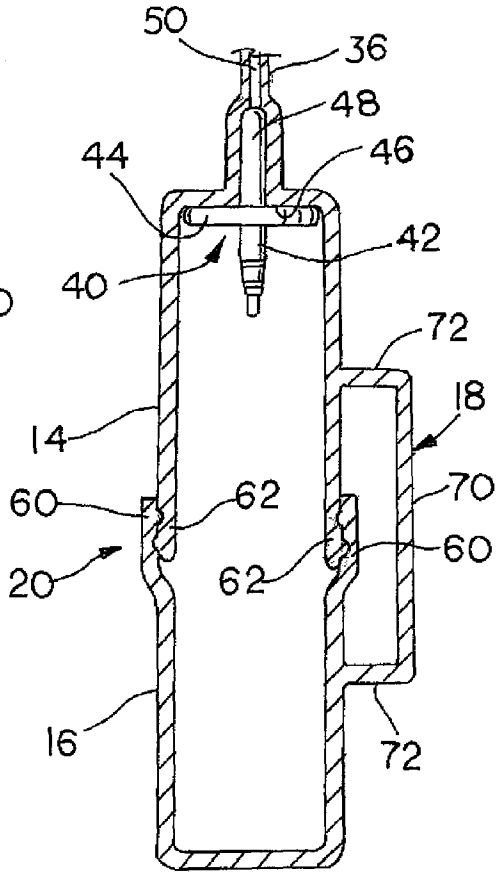
FIG. 4 shows a length wise cross-section of the enclosure shown in FIG. 1 and in a closed configuration.
Figure 3:
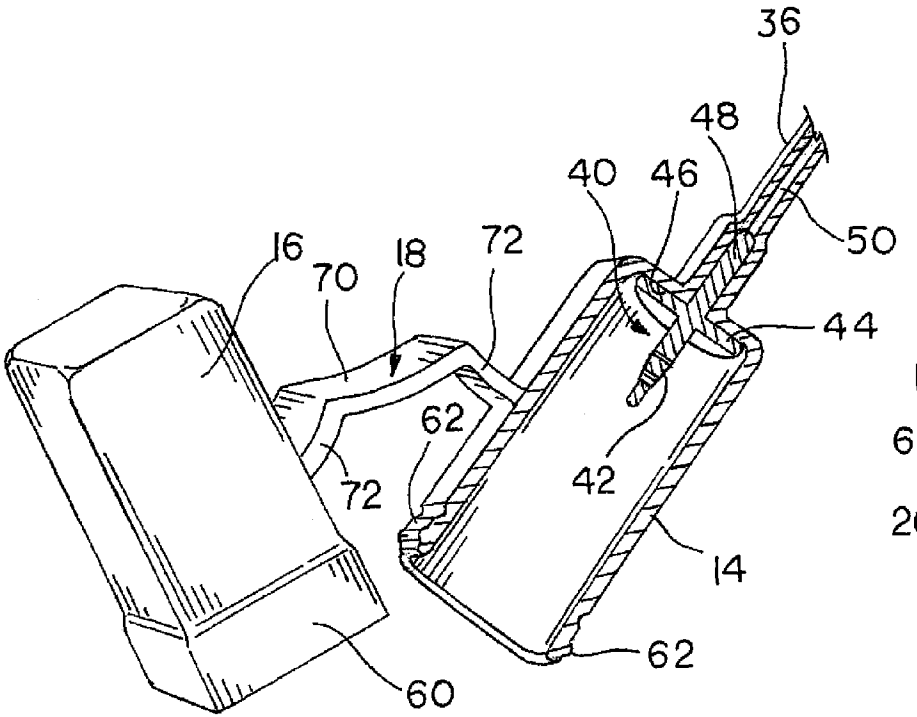
FIG. 3 shows the waterproof enclosure of FIG. 1 in an open configuration and with a first part of the enclosure shown in cross-section.

To create compression on the beads at the joint 20 upon assembly of the enclosure, the size of one or both of the parts 14 and 16 can be formed so as to be in relative tension when the case 12 is assembled. As shown in FIGS. 3 and 4 in this example, the bottom part 16 of the cover 12 includes a flared out region 60 that is sized to accept a seal region 62 on the upper part 14 within the flared out region 60. The size of the flared out region 60 can be such that when the appropriate music player is inserted into the interior of the cover 12 and the two parts 14 and 16 are assembled, the flared out region must be stretched at least slightly to fit over and surround the seal region 62 on the upper part. The resiliency of the material of the case 12 can be such to cause the bottom part 16 to be in tension within the flared region 60. The tension will compress the beads 56. The seated grooves and ribs can provide positive feedback to a user that the two parts 14 and 16 are properly and fully sealed and seated.

Figure 7:
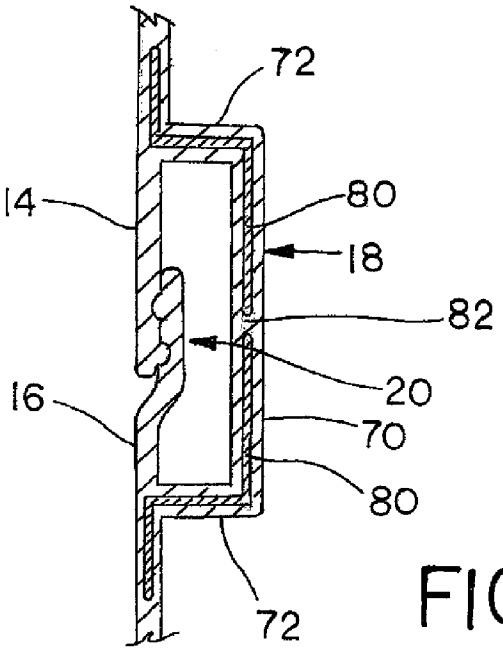
FIG. 7 shows an alternative example of the tether for the waterproof enclosures disclosed and described herein.

As shown in FIGS. 3 and 7, the tether 18 can also be integrally molded as part of the cover 12. The tether includes a bridge 70 and a pair of stand offs 72 on opposed ends of the bridge 70. The stand offs can be integrally molded as part of the respective cover parts 14 and 16 to retain the two parts together, even when in the open configuration as shown in FIG. 3. In one example, the tether 18 can be formed entirely of the same material and integrally molded with the case 12 and thus be fully flexible. In another example, substantially rigid or relatively stiff inserts 80 can be in-molded or dual molded as a part of the tether 18. As shown in FIG. 7, a gap 82 between two portions of in-molded inserts 80 within the bridge 70 can be created. This can allow the bridge 70 to bend at the gap 82 when the two cover parts 14 and 16 are in the open configuration of FIG. 3. In the closed position, the stiff inserts can assist in providing strength and rigidity to the tether 18, rendering the tether useful and durable as an attachment loop. The tether 18 can thus be used to attach the personal music player and the waterproof enclosure 10 during use. As shown in FIG. 7, the inserts can be configured to create a contour for the loop and can extend into parts of the case 14 and 16 if desired for added strength and rigidity I the closed configuration.

The enclosure 10 disclosed and described herein can be formed from any number of suitable materials. However, in one example, the material can be substantially flexible and resilient to perform its intended function and also be waterproof. In a particular example, the material can be hydrophobic such that it resists capillary action to further enhance the seal at the joint 20. Such materials can also be utilized and configured in a manner to tightly follow the contour of a personal music player housed within the interior of the enclosure. Snug or tight surface-to-surface contact between the external surfaces of the music player and the interior surfaces of the enclosure 10 can further resist water being able to enter the waterproof enclosure during use.

Another benefit of using a substantially flexible material for fabricating the enclosure is that a user may be able to operate the controls of the music player through the exterior case 12 during use. The flexibility of the material can permit a person to press buttons and manipulate actuators on the music player without having to open the enclosure. Thus, the unit can be fully used under water. In one example, a liquid silicone rubber material or other similar gel-like or jelly like material can be used to integrally mold the case 12, the lineout 36, and the tether 18. Such materials, when molded, can be highly flexible, bead water, and have a tacky surface feel. The contact points at the joint can thus create a substantial water tight seal due to the characteristics of the material. The flexible and resilient nature of such materials can permit easy insertion and removal of a music player from the unit and configuration of the cover to closely follow the contour of a given player. Such materials can also be puncture resistant and leak resistant even if punctured.

As will be evident to those having ordinary skill in the art, the size, shape, configuration, and material of the flexible waterproof enclosure 10 and earpiece and sound emitting components can vary considerably and yet fall within the spirit and scope of the present invention. The material used for the flexible skin or case 12 can be any suitable flexible elastomeric material. The earpiece or headphone jack can be in-molded so as to make the entire assembly one piece as shown and described. Alternatively, the earpieces, lineout and jack adapter could be a separate part of the assembly that would be attached with a waterproof impermeable seal. The two sections pr parts 14 and 16 of the flexible case could be molded and interconnected by a tether as one piece, as in the example shown. Alternatively, the covering could be molded as two pieces if such configuration would be better suited to a particular personal music player or a particular seal design. The loop can be as shown connecting the two sections or portions of the case, or could be omitted or made to be entirely on one portion or the other. The enclosure can be used to cover any personal electronic device. However, in one example, the disclosed enclosure can be particularly suited for digital audio devices such as MP3 players or Apple's iPod units.

Although certain waterproof enclosures and features for personal music players or other electronic devices have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A waterproof enclosure for use with personal music players, the enclosure comprising:

a case formed of a flexible material and having an interior sized to received a personal music player, the case having a first part and a second part that together define the interior, wherein the case can be opened to expose the interior and can be closed along a joint;

a watertight seal provided along the joint between the first and second parts when closed;

a tether connecting the first and second parts of the case; and a sound emitting device extending from the case, wherein the tether is configured to create an attachment loop with the case in the closed position.

2. A waterproof enclosure according to claim 1, wherein the watertight seal extends circumferentially around the case and is provided in part on each of the first and second parts of the case.

3. A waterproof enclosure according to claim 2, wherein the watertight seal and the first and second parts of the case are integrally molded from a liquid silicone rubber material.

4. A waterproof enclosure according to claim 1, wherein the tether is integrally molded from the flexible material of the case.

5. A waterproof enclosure according to claim 1, wherein the sound emitting device comprises:

a jack adapter having a stem projecting into the interior of the case and a retainer that prevents the stem from being pulled from the case;

a lineout extending from the jack adapter; and at least one waterproof earpiece with a sound emitting component coupled to a distal end of the lineout.

6. A waterproof enclosure according to claim 5, further comprising:

one or more wire leads extending from the jack adapter to the sound emitting component, wherein the one or more wire leads are encased in a material of the lineout integrally molded as part of the case.

7. A waterproof enclosure according to claim 1, wherein the sound emitting device includes an audio adapter coupled to the case and having a stem projecting into the interior, the stem sized to connect with an earphone jack of a personal music player, wherein a part of the audio adapter is integrally covered by the flexible material forming the case.

8. A waterproof enclosure according to claim 7, the sound emitting device further comprising:

a wire lead extending from the audio adapter to a waterproof sound emitting component, wherein a lineout is integrally formed from the flexible material as part of the case with the wire lead and a part of the audio adapter being encased in the flexible material of the lineout.

9. A waterproof enclosure according to claim 5, wherein the lineout is integrally formed from the flexible material as part of the case, and wherein part of the jack adapter and the waterproof earpiece with a sound emitting component are encased in the flexible material of the lineout.

10. A waterproof enclosure according to claim 1, wherein the flexible material of the case permits actuation of the at least one control device through the case.

* * * * *